US007430364B2

(12) United States Patent
Howansky et al.

(10) Patent No.: US 7,430,364 B2
(45) Date of Patent: Sep. 30, 2008

(54) COOLER HEAD VAPORIZER

(75) Inventors: Andrew Howansky, Copake Falls, NY (US); Zhijing Wang, Clifton Park, NY (US); Linda Hotz, New City, NY (US); Christopher S. Kanel, Hudson, NY (US)

(73) Assignee: Kaz Incorporated, Hudson, NY (US)

( * ) Notice: Subject to any disclaimer, the term of this patent is extended or adjusted under 35 U.S.C. 154(b) by 39 days.

(21) Appl. No.: 11/246,961

(22) Filed: Oct. 7, 2005

(65) Prior Publication Data

US 2007/0081802 A1 Apr. 12, 2007

(51) Int. Cl.
*H05B 3/60* (2006.01)
*F22B 1/20* (2006.01)

(52) U.S. Cl. ..... 392/337; 392/386

(58) Field of Classification Search ..... 392/324–338, 392/386–406

See application file for complete search history.

(56) References Cited

U.S. PATENT DOCUMENTS 3,420,509 A * 1/1969 Briggin et al. ..... 261/142
3,659,078 A * 4/1972 Rudstrom ..... 392/337
3,971,913 A * 7/1976 Myklebust ..... 392/337
4,132,883 A 1/1979 Grime
4,463,248 A 7/1984 Katzman et al.
5,228,213 A 7/1993 Caruso
5,355,591 A 10/1994 Caruso
5,970,211 A 10/1999 Ritsher et al.
6,560,408 B2 * 5/2003 Glucksman et al. ..... 392/403
2002/0154903 A1 10/2002 Glucksman et al.

* cited by examiner

*Primary Examiner*—Sang Y Paik
(74) *Attorney, Agent, or Firm*—Darby & Darby

(57) ABSTRACT

A vaporizer for providing water vapor at a safer and reduced temperature comprises a water tank and steam generating unit. The steam generating unit is an assembly of a multi-walled chamber, top cover portion and safety grill. The safety grill establishes a distance between a water vapor outlet situated on the top cover portion and the point where an individual may contact the water vapor. This distance allows the temperature of the water vapor to be reduced to a safer temperature. Additionally, the vaporizer includes a condensation recycling port that receives water vapor droplets that form about the steam generating unit and returns those droplets to a boiling chamber where the water droplets are recycled into water vapor. Finally, the top cover portion includes a water barrier to protect electrical components near the water vapor outlet.

16 Claims, 5 Drawing Sheets

COOLER HEAD VAPORIZER

FIELD OF THE INVENTION

The present invention generally relates to the field of vaporizers and humidifiers, and more specifically to a vaporizer enabled to provide a cooler and, therefore, safer stream of vapor to the environment.

BACKGROUND OF THE INVENTION

Various types of products for increasing the humidification levels of an environment have been in common use for many years. Environments having low levels of humidity, such as the home or office, result in an overall discomfort to the individuals in that environment, particularly during the winter season. Typical problems resulting from low humidity levels in the home are dry sinus cavity and nasal passages, dry and itchy skin that can result in the development of rashes, and scratchy throats. Additionally, maintaining reasonable levels of humidification is especially important for those with respiratory ailments, particularly young children. An environment having an adequate level of humidification improves recovery time and reduces breathing difficulties.

Humidifiers and vaporizers humidify the air by increasing the air's moisture or water content. Typical categories of products used to increase humidity levels in a home include evaporative or impeller type humidifiers and water vaporizers. Evaporative type humidifiers typically utilize motors, fans, wicks and impellers to distribute water vapor from water contained in a water reservoir. Water vaporizers, on the other hand, disperse water vapor by heating the water in a reservoir to a boiling state so that steam is created. That steam subsequently exits the vaporizer's nozzle at a temperature of about 212 degrees Fahrenheit, to provide pure water vapor to the environment.

Presently used water vaporizers cause water vapor to travel out from the exit nozzle of the humidifier at a temperature of about 212 degrees Fahrenheit. Water vapor at about 212 degrees Fahrenheit, if allowed to come into contact with human skin, can cause serious burns in a short period of time. Thus, what is desired is a water vaporizer that provides pure water vapor to an environment while maintaining a safer exit temperature for the vapor.

Additionally, water vapor will occasionally cause condensation, in the form of water droplets, to form around the vapor outlet of the vaporizer. Currently available water vaporizers fail to utilize those droplets of water that may form, causing the condensation droplets to be completely wasted at best and corrode vaporizer components at worst. Accordingly, what is needed is a water vaporizer that is capable of recycling the water droplets which are formed as a result of the condensation that occurs near the vapor outlet.

SUMMARY OF THE INVENTION

The present invention is directed to a vaporizer that emits vaporized water through an outlet into the environment while maintaining a reduced temperature of that vapor at the outlet. As mentioned, a reduced temperature of the vapor is beneficial to children and adults from a safety point of view. Additionally, since the temperature of the vapor has been reduced, condensation droplets form more rapidly than with typical vaporizers. The vaporizer of the present invention recycles the water droplets into the boiling chamber where the steam was originally generated.

The vaporizer of the present invention includes a water tank having an opening on its top surface for receiving a steam generating unit. The steam generating unit is an assembly that includes a multiple-walled, e.g., triple-walled chamber, a steam generating unit cover portion and a safety grill. The triple-walled chamber includes an innermost chamber or boiling chamber, an intermediary air chamber and an outer or water chamber. Along the top side of the triple-walled chamber, and immediately above the boiling chamber, is a water baffle having a vertical slot at one end. The water baffle is a raised structure that is an extension of the boiling chamber. As the boiling chamber produces the water vapor, it may occasionally cause spraying of water droplets. The water baffle prevents the spraying water droplets from traveling through the vapor outlet and to other areas of the steam generating unit and in particular the light connected to the top cover portion. The slot allows any water condensation that has formed to flow back into the boiling chamber. Also, along the outer side of the triple-walled chamber is a locking fin. The locking fin is aligned with a slot along the opening of the water tank and allows the steam generating unit to be removed from the water tank. The locking fin is a safety feature for young children as the steam generating unit cannot be abruptly removed from the tank unless the locking fin is aligned with the slot of the water tank opening.

Connected to the top edge of the triple-walled chamber is the steam generating unit cover portion. The steam generating unit cover portion houses the majority of the electrical circuitry of the vaporizer. In fact, the steam generating unit contains two opposed electrode rods, conventionally used in the art, for boiling the water in the boiling chamber.

Additionally, the steam generating unit cover portion includes a water vapor outlet for directing water vapor created in the inner or boiling chamber and a condensation recycling port that serves to return the water droplets that form about the steam generating unit cover portion. Situated above the steam generating unit cover portion is a safety grill. The safety grill includes openings or vents that allow the water vapor to be directed by the water vapor outlet into the environment. The safety grill establishes a particular distance between the water vapor outlet and the point at which the steam is contactable by an individual in the open environment. The vents of the safety grill also allow ambient air to mix with the water vapor to reduce the temperature of the water vapor exiting through the safety grill. As a result, the temperature of the water vapor exiting through the safety cage is reduced to the cooler temperature of about 160-180 degrees Fahrenheit.

Along the top side of the steam generating unit top cover portion is a water barrier. The water barrier, a raised wall-like structure, is situated generally about the center axis of the steam generating unit top cover portion. The water barrier separates the electrical connectors and components from the water vapor outlet. As noted, condensation may form in the vicinity of the water vapor outlet. The water barrier serves to protect the electrical components of the vaporizer from malfunction due to exposure to the water droplets resulting from condensation or spraying.

At one of the corners of the water tank is a water level marker. The water level marker is an indented portion of the water tank that allows a user to view the appropriate level of water within the tank while the tank is being filled, thus ensuring that the maximum amount of water has been added to the tank prior to use.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 7:
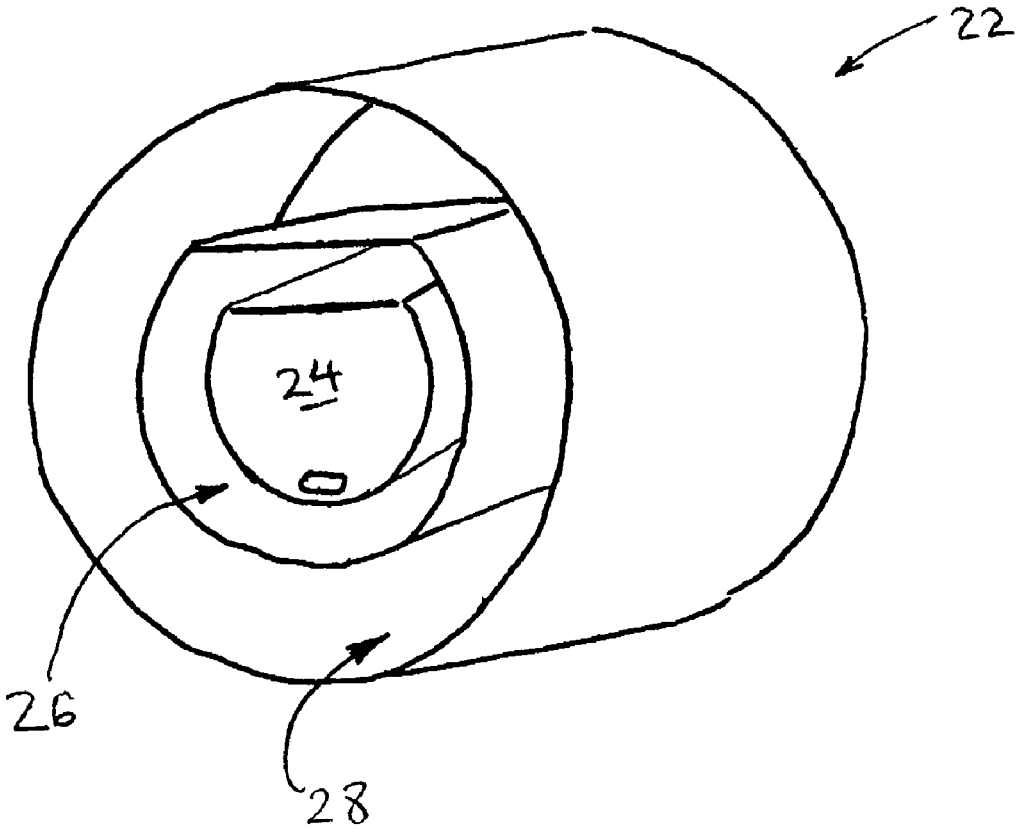
FIG. 7 is a bottom perspective view of the triple-walled chamber.

Referring now to FIGS. 1-7, the present invention is directed to a vaporizer 2 that emits water vapor through an outlet into the environment while maintaining a reduced temperature of that vapor at an outlet. As the temperature of the vapor has been reduced, condensation droplets form more rapidly than with typical vaporizers. The vaporizer of the present invention recycles the water droplets by directing them back into a boiling chamber 24. Alternately, the water droplets are directed into an outer water chamber 28 before being directed back into boiling chamber 24 (FIG. 7).

Figure 1:
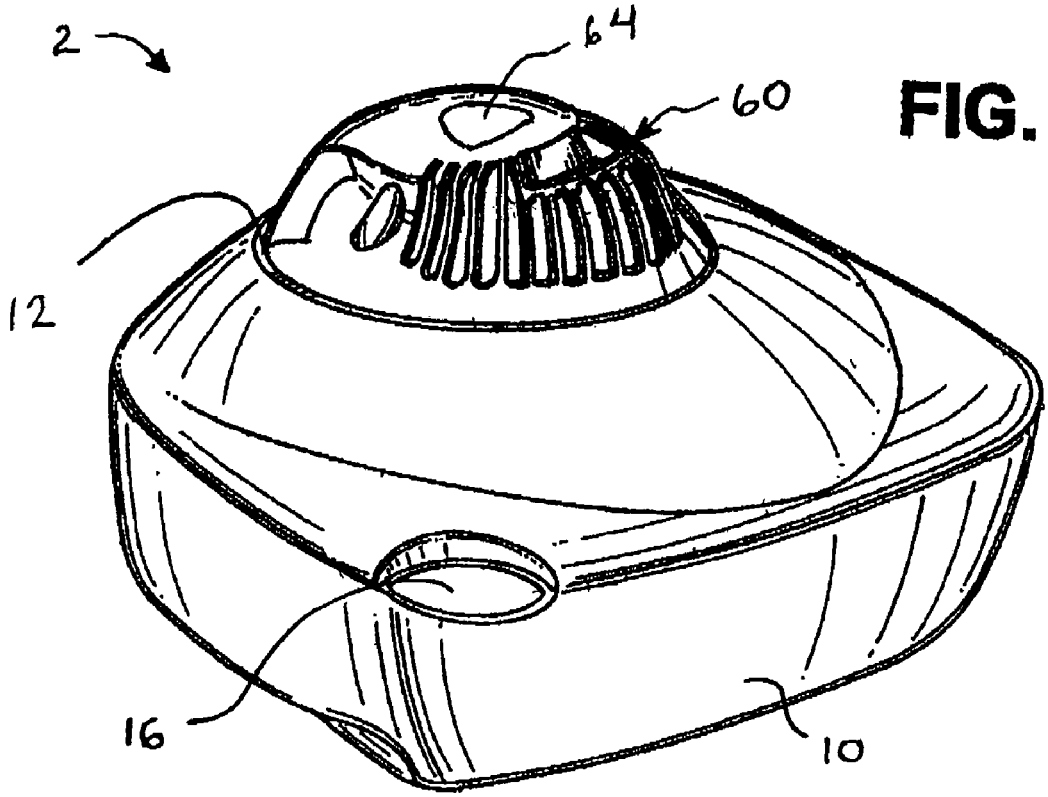
FIG. 1 is a front perspective view of a cooler-head vaporizer constructed in accordance with the present invention.
Figure 2:
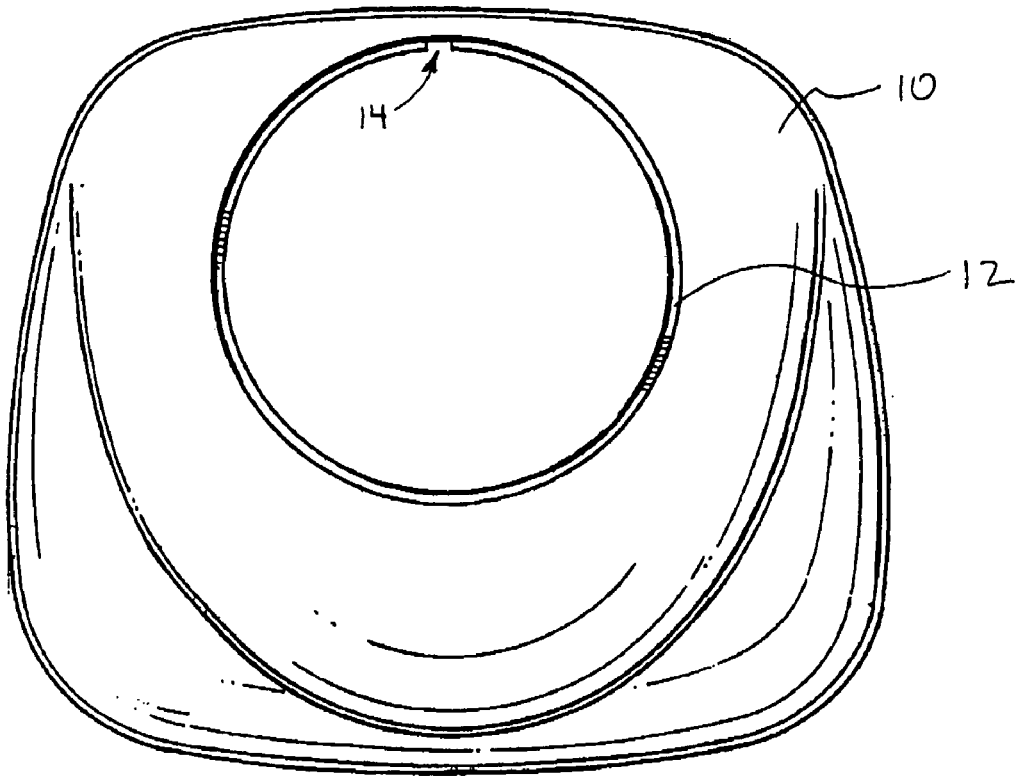
FIG. 2 is a top plan view of the opening in the water tank.
Figure 4:
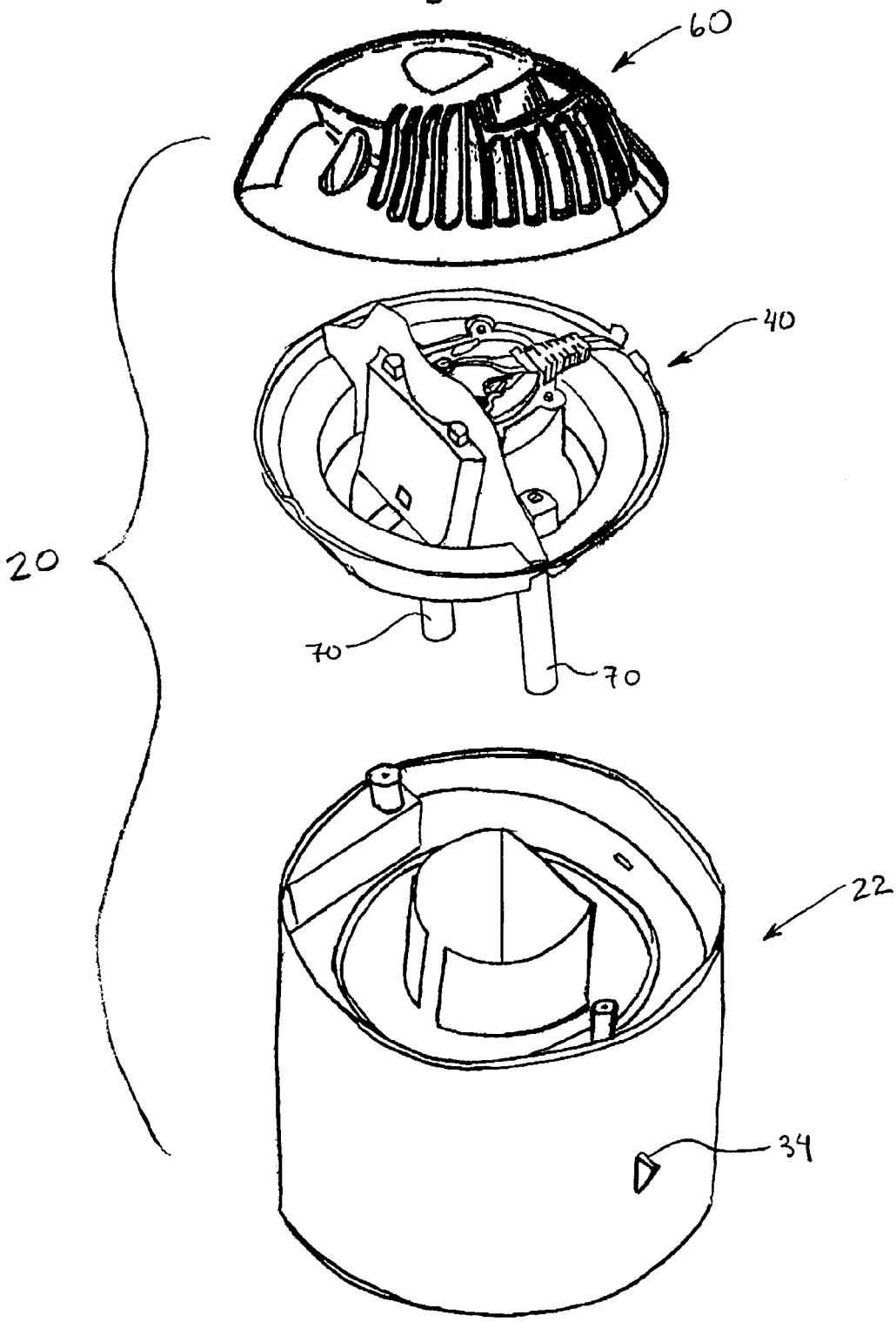
FIG. 4 is an exploded view of the steam generating unit.

Referring now to FIGS. 1 and 4-7, the vaporizer of the present invention includes a water tank 10 having an opening 12 on its top surface for receiving a steam generating unit 20. As can be seen in FIG. 4, the steam generating unit 20 is an assembly that includes a triple-walled chamber 22, a steam generating unit cover portion 40 and a safety grill 60. As illustrated in FIG. 1, the steam generating unit 20 fits within the water tank 10 and draws the water from the water tank 10 into the boiling chamber 24 of the steam generating unit 20 to create water vapor.

The triple-walled chamber 22 includes an innermost chamber or boiling chamber 24, an intermediate air chamber 26 and an outer water chamber 28. The boiling chamber 24 receives water from an opening in its bottom portion. As is well known in the art, the temperature of that water is raised using two opposing electrode rods 70 connected to the electrical circuitry 72 of the vaporizer. The intermediate air chamber 26 holds air which insulates the water in the boiling chamber 24 from water in the tank 10 so as to prevent the entire tank of water from increasing in temperature. The outer water chamber 28 ballasts the steam generating unit 20 for stability and also directs the water from the tank 10 to the boiling chamber 24.

Figure 5:
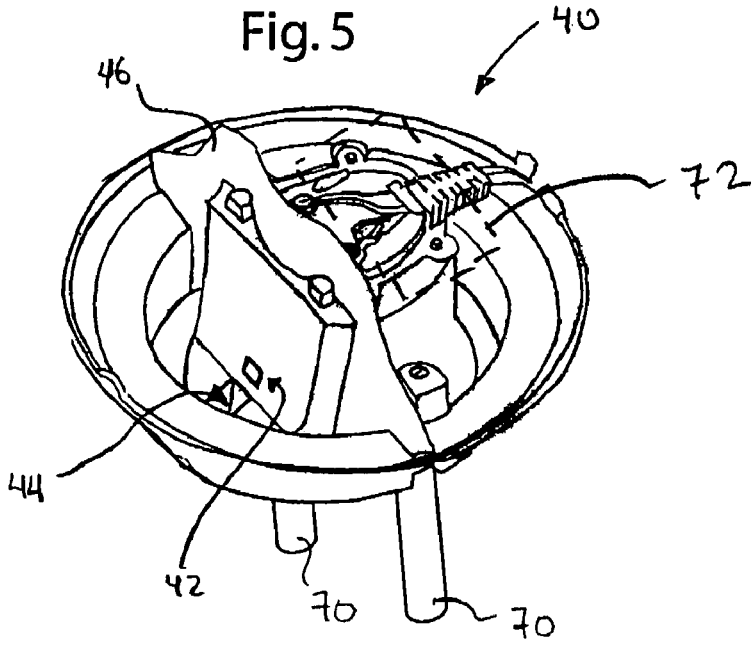
FIG. 5 is a perspective view of the top cover portion.
Figure 6:
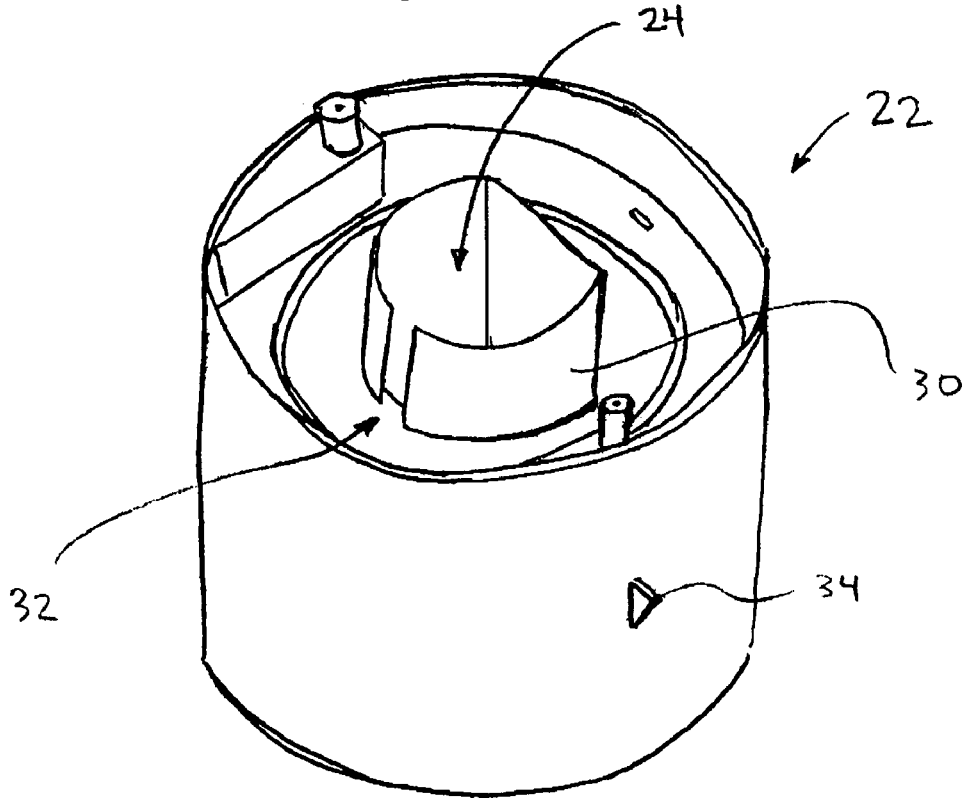
FIG. 6 is a top perspective view of the triple-walled chamber.

As illustrated in FIGS. 4 and 5, at the top side of the triple-walled chamber 22, and immediately above the boiling chamber 24, is a water baffle 30 having a baffle slot 32 at one end. The water baffle 30 is a raised structure that is an extension of the boiling chamber 24. As the boiling chamber 24 produces water vapor, it may occasionally cause spraying of water droplets. The water baffle 30 prevents the spraying water droplets from traveling through the vapor outlet 42 to other areas of the steam generating unit 20. The baffle slot 32 allows any water condensation that has formed to flow back into the boiling chamber 24. Also, along the outer side of the triple-walled chamber 22 is a locking fin 34. The locking fin 34 is aligned with a slot 14 along the opening 12 of the water tank 10 and allows the steam generating unit 20 to be removed from the water tank 10. The steam generating unit 20 can be removed from the water tank 10 only when the locking fin 34 is aligned with the slot 14 on the water tank opening 12, thus preventing abrupt or inadvertent removal of the steam generating unit 20.

Referring now to FIG. 4, connected to the top edge of the triple-walled chamber 22 is the steam generating unit cover portion 40. The steam generating unit cover portion 40 houses the majority of the electrical circuitry 72 of the vaporizer 2. The electrical circuitry 72 is connected to the opposing electrode rods 70, which are conventionally used in the art. As is well known in the art, when power is supplied to the vaporizer 2, a voltage difference is created between the opposing electrodes 70. The conductivity of the water, i.e., minerals in the water, or by the addition of salt, creates an environment that allows current to flow creating heat. The result is that the temperature of the water in the boiling chamber 24 is raised to a boil, which in turn creates water vapor.

Additionally, the steam generating unit cover portion 40 includes a water vapor outlet 42 for directing water vapor created in the inner boiling chamber 24 to the environment. Situated below the water vapor outlet 42 is a condensation recycling port 44. The condensation recycling port 44 returns any water droplets that form in the area about the steam generating unit cover portion 40 to the boiling chamber 24. In an alternate embodiment, the outer water chamber 28 can receive condensation water droplets collected by the condensation recycling port 44. The outer water chamber 28 then directs the initial and recycled water to the boiling chamber 24. A further embodiment allows the condensation to be directed to both the boiling chamber 24 and the outer water chamber 28.

Figure 3:
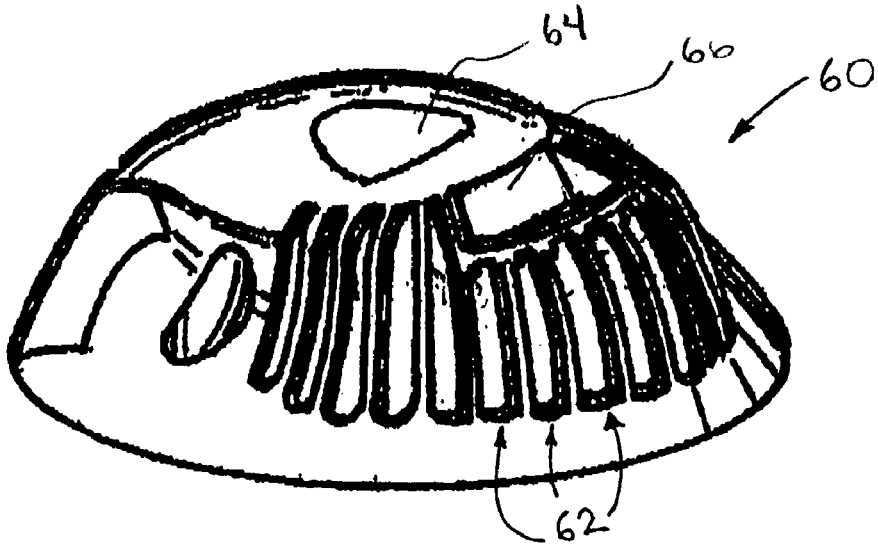
FIG. 3 perspective view of a safety grill of the cooler-head vaporizer constructed in accordance with the present invention.

Situated above the steam generating unit cover portion 40 is a safety grill 60 (FIG. 3). The safety grill 60 includes openings or vents 62 that allow the water vapor directed by the water vapor outlet 42 into the environment. Moreover, the safety grill 60 establishes a particular distance between the water vapor outlet 42 and the point at which the steam is contactable by an individual in the open environment. The vents 62 of the safety grill 60 also allow ambient air to mix with the water vapor to reduce the temperature of the water vapor exiting through the safety grill vents 62. As a result, the temperature of the water vapor exiting through the safety grill vents 62 is reduced to the cooler temperature of about 160-180 degrees Fahrenheit.

Along the top side of the steam generating unit top cover portion 40 is a water barrier 46. The water barrier 46, a wall-like structure, is situated generally about a center axis of the steam generating unit top cover portion 40 and extends from the top cover portion 40 to the safety grill 60. The water barrier 46 separates the electrical connectors and components from the water vapor outlet 42. As noted, condensation forms in the vicinity of the water vapor outlet 42, top cover portion 40 and safety grill 60. The water barrier 46 protects the electrical components of the vaporizer from malfunction due to exposure to the water droplets resulting from condensation or spraying by blocking any water droplets from traveling to the electrical circuitry 72.

Referring to FIG. 3, the safety grill 60 may be made of temperature resistant plastic or any other suitable material. The safety grill vents 62 are vertically spaced apart vents along the front and rear sides of the safety grill. The rear vents provide air cooling to the electrical circuitry 72 while the front vents 62 allow water vapor to enter the environment. Alternatively, various shapes and sizes of vents may be used. The safety grill 60 can be adapted to alternatively include vents whose orientation or sizing may be changed to change the direction of the water vapor output or the amount of water vapor introduced into the environment, respectively. The safety grill 60 further includes an opening to allow a light 64, integrally connected to the steam generating unit top cover portion 40, to be visible. A final component of the safety grill 60 is the medicine cup 66. The medicine cup 66 is a recessed cup-like portion situated on the upper portion of the safety grill 60 above the water vapor outlet 42. The water vapor exiting the water vapor outlet 42 heats the medicine cup 66 and its contents to release the medicine into the environment and thus provide additional relief to those suffering from respiratory ailments.

As illustrated in FIG. 1, a corner of the water tank 10 includes a water level marker 16. The water level marker 16 is an indented portion of the water tank 10 that allows a user to view the level of water in the tank 10. When the water tank 10 is filled with water to the level of the water level marker 16, a user has added the maximum amount of water the tank may hold. Thus, the water level marker 16 ensures that the maximum amount of water has been added to the tank 10 prior to the vaporizer 2 being operated.

In use, the water tank 10 is filled to the water level marker 16 and the steam generating unit 20 is situated within the tank 10. Once the steam generating unit 20 is connected to a power source, the opposing electrode rods 70 within the boiling chamber 24 are charged and cause the water temperature therein to boil. The power supplied also illuminates the light 64 to provide a soft glow near the safety grill 60. Water vapor then travels up through the boiling chamber 24 and through the water vapor outlet 42. Any water droplets forming below the water vapor outlet 42 are blocked by the baffle 30 and directed to the baffle slot 32 and back into the boiling chamber 24. As the water vapor exits the water vapor outlet 42 it mixes with ambient air and is reduced in temperature before exiting into the environment through the safety grill vents 62. Any water droplets forming in the vicinity of the safety grill 60 or top cover portion 40 travel through the condensation recycling port 44 to be converted back into water vapor. This process is repeatedly carried out by the vaporizer while in use.

While the invention has been particularly shown and described with reference to preferred embodiments thereof, it will be understood by those skilled in the art that various changes in form and details may be made therein without departing from the spirit and scope of the invention.

What is claimed is:

1. A vaporizer comprising:

a water tank having an opening;

a steam generating unit disposed within the opening and in fluid communication with the water tank for generating steam at a first temperature;

the steam generating unit comprising:

a multi-walled chamber;

a top cover portion at least partially covering the multi-walled chamber; comprising:

a water vapor outlet; and a condensation recycling port formed on the top cover portion to provide an opening for directing water droplets directly to a boiling chamber situated within the multi-walled chamber; and a safety grill disposed above the top cover portion and including at least one vent for emitting water vapor discharged from the water vapor outlet at a second temperature which is less than said first temperature.

2. The vaporizer of claim 1, wherein the at least one vent introduces ambient air to the water vapor emitted from the water vapor outlet to cool the water vapor.

3. The vaporizer of claim 1, wherein the multi-walled chamber comprises a triple-walled chamber and further includes an intermediate chamber substantially filled with air and an outer water chamber.

4. The vaporizer of claim 3, wherein the intermediate air chamber insulates water in the water tank from water in the boiling chamber.

5. The vaporizer of claim 4, wherein the top cover portion further includes a water barrier.

6. The vaporizer of claim 5, wherein the water barrier includes a raised wall generally along a center axis of the top cover portion.

7. The vaporizer of claim 5, wherein the triple-walled chamber includes a baffle wall and a baffle wall slot with the baffle slot in fluid communication with the boiling chamber.

8. The vaporizer of claim 7, wherein the top cover portion includes a light.

9. The vaporizer of claim 8, wherein the light is visible through an opening in the safety grill.

10. The vaporizer of claim 3, wherein the outer water chamber ballasts the steam generating unit.

11. The vaporizer of claim 10, wherein the triple-walled chamber has an outer side and an inner side proximate the outer water chamber.

12. The vaporizer of claim 11, wherein the outer side of the triple-walled chamber includes a locking fin.

13. The vaporizer of claim 12, wherein the opening in the water tank includes a slot adapted to receive the locking fin.

14. The vaporizer of claim 1, wherein the safety grill includes a medicine cup.

15. The vaporizer of claim 1, wherein the at least one vent is disposed a distance above the top cover portion.

16. The vaporizer of claim 1, wherein the top cover portion further comprises a water barrier protecting electrical components disposed in the vaporizer from moisture.

* * * * *